United States Patent [19]

Koslowsky

[11] 4,104,290

[45] Aug. 1, 1978

[54] PROCESS FOR SEPARATING OILS AND FATS INTO LIQUID AND SOLID FRACTIONS

[75] Inventor: Ladislav Koslowsky, Ramat-Gan, Israel

[73] Assignee: H.L.S. Ltd., Industrial Engineering Company, Petah-Tikva, Israel

[21] Appl. No.: 738,914

[22] Filed: Nov. 4, 1976

Related U.S. Application Data

[63] Continuation of Ser. No. 612,978, Sep. 12, 1975, abandoned.

[30] Foreign Application Priority Data

Feb. 7, 1975 [IL] Israel ..... 46595

[51] Int. Cl.[2] ..... C11B 7/00; C11B 11/00

[52] U.S. Cl. ..... 260/428.5; 426/417; 426/429

[58] Field of Search ..... 426/417, 429, 495; 260/428, 428.5

[56] References Cited

U.S. PATENT DOCUMENTS

| | | | |
|---|---|---|---|
| 2,298,501 | 10/1942 | Meyers et al. | 260/428.5 |
| 2,443,063 | 6/1948 | Adelson | 260/428.5 |
| 2,678,937 | 5/1954 | Brennan et al. | 260/428.5 |
| 3,541,123 | 11/1970 | Kawada et al. | 260/428.5 |
| 3,708,512 | 1/1973 | Alexander et al. | 260/428.5 |

FOREIGN PATENT DOCUMENTS

| | | | |
|---|---|---|---|
| 557,457 | 11/1943 | United Kingdom | 260/428.5 |

*Primary Examiner*—Raymond N. Jones
*Assistant Examiner*—Esther M. Kepplinger
*Attorney, Agent, or Firm*—Ladas, Parry, Von Gehr, Goldsmith & Deschamps

[57] ABSTRACT

Separation of an edible oil into liquid and solid fractions. The edible oil is dissolved in about 0.5–4 parts by weight of a solvent being a $C_2$–$C_3$ alkanol containing about 2 to 10% by weight of water and the solution is cooled to a temperature at which it separates into two liquid phases and a solid fraction crystallizes. The crystallized solid fraction floats in the upper liquid phase and is recovered therefrom. The liquid fraction of the oil is recovered from the lower liquid phase.

19 Claims, No Drawings

PROCESS FOR SEPARATING OILS AND FATS INTO LIQUID AND SOLID FRACTIONS

This is a continuation of application Ser. No. 612,978 filed Sept. 12, 1975, now abandoned.

This invention relates to fractional crystallization of vegetable and animal oils and fats. More particularly, the invention provides a new and efficient process for separating such oils and fats, by crystallization, into a less saturated fraction (hereinafter "liquid fraction") and a more saturated fraction (hereinafter "solid fraction").

The present invention is of particular value for the production of "salad oil," i.e. liquid unsaturated edible oil, from such natural or semi-processed oils and fats as contain relatively large proportions of saturated fatty acids (in the form of triglycerides). A high quality salad oil is required to have a good "chilled stability," i.e. a resistance to crystallization when kept for at least 72 hours at a relatively low temperature. The chilled stability of an oil, is a function of its degree of unsaturation, conventionally measured as the "iodine value." The higher the iodine value, the lower the temperature at which the oil resists crystallization. Thus, in order to obtain from comparatively saturated oils and fats a liquid fraction having the desired characteristics of a salad oil, it is necessary to increase the degree of unsaturation of the oil or fat by separating therefrom a solid fraction containing a desirably large proportion of the saturated fatty acids. Fractional crystallization techniques have been used for this purpose.

In accordance with the known methods, the oil or fat is dissolved in several times its volume of a solvent, such as acetone or hexane, at an elevated temperature, and the selective crystallization of a solid fraction is induced by cooling the solution. The main disadvantage of such known processes resides in the need to resort to filtration or centrifugation for the separation of the solid fraction crystals from the residual solution. Owing to the low melting points and to the sticky consistency of the crystals, the aforesaid operations are very cumbersome and the separation of the phases is inefficient.

Furthermore, in these processes it is, as a rule, necessary to produce the crystals in the branched-out beta-form, in order to make the filtration at all possible. However, the production of the crystals in the beta-form is a time consuming operation as distinguished from the ready formation of the spherically-shaped alpha-form. This then constitutes a further disadvantage of the prior art processes.

The present invention provides a process which is free from the aforesaid drawbacks in that it does not involve any filtration or centrifugation and permits neat and easy separation of the liquid and the solid fractions by a simple decantation.

The invention thus provides a process for separating an edible oil selected from amongst natural and semi-processed animal and vegetable oils and fats and mixtures thereof into a less saturated fraction (liquid fraction) and a more saturated fraction (solid fraction), comprising dissolution of the oil in a solvent, selective crystallization of the solid fraction from the resulting solution by cooling it to a temperature lower than the dissolution temperature, separation of a crystalline solid fraction from a liquid fraction and removal of solvent from each of said fractions, characterized in that a $C_2$–$C_3$ alkanol containing about 2 to 10% by weight of water is used as the solvent in an amount of about 0.5 to 4 parts by weight for each part of the oil, and in that after cooling a resulting upper layer containing the crystalline solid fraction of the oil in suspension, is separated by decantation from a lower layer containing the liquid fraction of the oil.

The edible oil and the aqueous alkanol solvent, at the above specified weight ratios, are completely miscible only at elevated temperatures. When the resulting solution is cooled, the solvent partially separates as an upper layer above the heavier oil layer which still contains some solvent. At the same time the cooling also causes crystallization of the solid fraction of the oil. The formed crystals contain considerable amounts of alkanol (probably as solvent of crystallization) and consequently their density is sufficiently low so that they float up into the upper solvent layer in which they form a suspension. The floating of the crystals and the sharp separation of the layers are also facilitated by the decreased viscosity of the oil layer owing to its aqueous alkanol content.

It was surprising to find in accordance with the invention that this unexpected effect occurs upon selection of the above specified parameters. The simple separation of the floating crystals in accordance with the invention constitutes a non-obvious and significant technical progress.

The process of the invention is applicable to any vegetable or animal oil or fat or mixtures thereof, either in the crude or in a semi-processed (e.g. partially hydrogenated) state. The term "edible oil" will be used herein to embrace all these types of oils and fats. Examples of edible oils which are suitable starting materials for the process of the invention are palm oil, cottonseed oil, sunflower seed oil, rice bran oil, kapok seed oil, partially hydrogenated soybean oil as well as animal fats such as tallow, lard and marine oils.

The edible oil starting material should be degummed, dried and preferably deacidified. Although the process of the invention can be carried out successfully with crude edible oil containing up to about 10% free fatty acids (F.F.A.), it has been found that a decreased F.F.A content leads to an easier crystallization, a sharper separation of the layers on decantation and increased yields. Thus, edible oils which had undergone a physical refining or a caustic neutralization and drying, proved to be most suitable as starting materials for the process of the invention.

It has also been found in accordance with the invention that best results are obtained if the oil is pretreated so as to reduce the amount of monoglycerides contained therein. Monoglycerides, are degradation products of natural oil which are formed together with the free fatty acids by hydrolysis of the triglycerides, and they are thus present in all oils and fats having a considerable F.F.A. content. It has been found that a monoglyceride content of more than about 2% has adverse effects on the crystallization of the solid fraction and consequently on the efficiency of phase separation in accordance with the invention. The monoglyceride content of the oil can be reduced by caustic neutralization or by steam distillation under vacuum. In this way the monoglyceride content of crude palm oil can be reduced, for example, from 8.15 to 0.7%. A preferred method for eliminating the monoglycerides is to convert them to di- and triglycerides by esterification with the free fatty acids already contained in the crude oil. This can be accomplished by heating the crude oil for several hours at 250° under vacuum in the presence of a catalyst, e.g. 0.2% of stannous chloride.

In accordance with the invention, the degummed and dried oil, preferably after being deacidified and pretreated as described above to reduce its monoglycerides content, is dissolved in the aqueous $C_2$–$C_3$ alkanol solvent by heating the mixture at about 40° to 70° C., preferably with stirring. The solvent can be ethanol, n-propanol or isopropanol, containing from about 2 to about 10% by weight of water, preferably from 4 to 6% by weight. For each part by weight of oil 0.5 to 4 parts, preferably 1 to 2 parts by weight of solvent are used. Isopropanol is the preferred solvent. The solution is then cooled to the crystallization temperature which depends on the composition of the oil being processed. Thus, for example, cottonseed oil, sunflower seed oil, and kapok seed oil are successfully crystallized at about 0° to 10° C.

Certain edible oils which contain comparatively large proportions of saturated fatty acids in their triglycerides, are best fractioned in two stages, i.e. the liquid fractions obtained in a first fractional crystallization according to the present invention are submitted to a second such fractional crystallization at lower crystallization temperatures. If solutions of oils of this type were cooled directly in the first stage to these lower crystallization temperatures, the amount of crystalline solid fraction separating would be too great to be accommodated as a suspension in the upper layer, and a sharp separation of the layers would not be possible. Examples are palm oil, tallow and lard which can be crystallized efficiently in two stages, the first at about 15° to 30° C and the second at about 10° to 20° C.

A similar case is that of edible oils containing appreciable amounts if waxes, such as rice bran oil which contains about 2 to 4% of waxes and about 2 to 3% of stearines. In these cases a single stage separation in accordance with the invention does not lead to satisfactory results, because the wax crystals (which have a higher melting point than the solid fraction of the oil) tend to remain in the lower layer. It has now been found in accordance with a specific embodiment of the invention that the separation of the waxes can be achieved in a first stage fractional crystallization, if about 1 to 5% by weight of a solid fat having a comparatively high melting point (e.g. 42° to 45° C) are added to the solution of the edible oil. Upon cooling, (e.g. 15° C in the case of rice bran oil) the waxes crystallize together with the solid fat which acts as a carrier for the waxes. The mixed crystals accumulate as a suspension in the upper solvent layer and a sharp separation of the layers by decantation is made possible. The lower oil layer is then submitted to a second fractional crystallization according to the invention, at a lower temperature (e.g. 5° C for rice bran oil) in order to separate the liquid fraction of the oil from the solid fraction containing the stearines. The upper layer is heated to about 45° C whereupon the mixed crystals of the solid fat and the waxes dissolve and the resulting solution separates into two liquid phases: a lower layer of molten waxes containing some aqueous alkanol and an upper layer consisting of a solution of the solid fat in the aqueous alkanol. The layers are separated by decantation at the elevated temperature (45° C) and the upper layer is recycled for addition to the oil solution of a subsequent batch. The lower layer can be distilled in order to recover as residue the pure waxes which have a considerable commercial value, and as distillate the aqueous alkanol which is recycled for use in the second stage or in a subsequent batch.

It has been found that the process of the invention can be carried out more successfully if the solid fraction of the oil is induced to crystallize in the alpha form of the crystals which, owing to their spherical shape, separate much more easily than the branched-out crystals of the beta form. These alpha crystals may be induced to agglomerate into small spherical aggregates having an average diameter of 2–3 mm in order to facilitate their floating into the upper layer. Both these results can be achieved by stirring the mixture at the crystallization temperature for some time, before allowing it to stratify. Thus, in accordance with a preferred embodiment of the invention, the cooling of the solution to the crystallization temperature is effected rapidly in order to favour the formation of the alpha-crystals, and the resulting cooled mixture of phases is stirred for several hours in order to induce the agglomeration of the crystals. The crystallization times in accordance with this preferred procedure range from about 2 to 6 hours, as compared with crystallization times of about 12 to 16 hours needed to obtain the filterable beta-form of the crystals required in accordance with the prior art processes. Thus, the fact that the invention makes it possible, and even preferable, to use the alpha-form of the crystals, provides for a considerable saving of time, which is a further substantial advantage of the invention.

The lower oil layer and the upper solvent layer containing the crystals of the solid fraction, are then separated by decantation and are submitted separately to distillation in order to remove the solvent (i.e. the alkanol and the water) which can be recycled for re-use with a fresh batch of oil. The liquid and the solid fractions of the oil which are recovered as the distillation residues are preferably stripped of the residual amounts of alkanol and water by passing therethrough a controlled stream of a dry inert gas at elevated temperatures and under vacuum (e.g. at 120° C and 10 torr). The conventional direct steam stripping cannot be used in the present case, because this would increase the water content of the recycled alkanol. Dry carbon dioxide has been found to be most suitable for this purpose. If the liquid fraction is to be submitted to a second stage fractional crystallization, as described above, there is clearly no need to submit it to the stripping operation. In such cases it is even unnecessary to distill the lower layer in order to separate the solvent contained therein. The entire lower layer obtained in the first stage may instead be admixed with the amount of solvent necessary to restore the afore-specified weight ratio of oil to aqueous alkanol, and the solution thus obtained may be submitted to the second-stage fractional crystallization. In such cases it has been found advantageous to heat the starting solution of the second stage, before it is cooled to the crystallization temperature, in order to ensure complete dissolution of any solid fraction crystal nuclei which might be present therein.

By using an efficient solvent recovery system the solvent losses in the process of the invention can be decreased to practically negligible amounts. In a pilot plant using 95% aqueous isopropanol as solvent, the solvent losses amounted to a mere 1 to 2 kg. per 1 ton of oil processed.

The invention is illustrated by the following non-limiting Examples:

EXAMPLE 1

200 g of degummed palm oil were mixed with 200 g of isopropanol containing 5% by weight of water. The stirred mixture was heated to 60° C and stirring was continued at that temperature until a clear solution was obtained. The solution was cooled rapidly to 22° C under stirring and the stirring was continued at that temperature for 2 hours. The mixture was transferred into a cooled decantation vessel where it separated into two layers within 5 minutes. The layers were separated from each other by decantation.

The lower layer had a weight of 174 g and contained 36 g of isopropanol which was distilled off. The distillation residue consisted of 138 g of liquid fraction having a chilled stability at 22° C, an iodine value of 57.2 and a F.F.A. of 3.72%.

The upper layer (226 g) was distilled to yield 164 g of aqueous isopropanol in the distillate and, in the residue, 62 g of solid fraction having a slip point of 49° C, an iodine value of 42.6 and a F.F.A. of 8.06%.

EXAMPLE 2

(A) 200 g of deacidified palm oil were mixed with 200 g of isopropanol containing 5% by weight of water. The stirred mixture was heated to 60° C and stirring was continued at that temperature until a clear solution was obtained. The solution was then cooled rapidly to 25° C under stirring and the stirring was continued at that temperature for 2 hours. The mixture was transferred into a cooled decantation vessel where it deparated within a few minutes into two layers which were separated from each other by decantation.

The lower layer had a weight of 194 g and contained 44 g of isopropanol which was distilled off. The distillation residue consisted of 150 g of liquid fraction having a chilled stability at 25° C and an iodine value of 55.

The upper layer (206 g) was distilled to yield 156 g of aqueous isopropanol in the distillate and 50 g of solid fraction in the residue, having a slip point of 48° C and an iodine value of 36.

(B) 150 g of the liquid fraction obtained above were mixed with 150 g of isopropanol containing 5% by weight of water and the mixture was heated with stirring to 60° C. After a clear solution was obtained, it was cooled rapidly to 15° C with stirring and stirred at that temperature for 2 hours. The mixture was then transferred into a decantation vessel, precooled to 15° C, where it separated in less than 10 minutes into two layers which were separated by decantation.

The lower layer (143.6 g) contained 23.6 g of aqueous ispropanol which was distilled off to leave 120 g of a residue consisting of a liquid fraction having a chilled stability at 18° C, an iodine value of 63 and a cloud point of 5° C. The yield of this liquid fraction (based on the weight of initial palm oil) was 60%.

The upper layer (156.4 g) was separated by distillation into 126.4 g of aqueous isopropanol and 30 g of solid fraction having a slip point of 34° C and an iodine value of 47.

The two solid fractions were combined to yield 80 g (40% of initial palm oil) of a solid fraction having a slip point of 42° to 43° C and an iodine value of 41.5.

The fatty acid composition of the deacidified palm oil starting material and of the various fractions obtained as described above were determined by gas chromatography and are represented in the following Table I in percentages by weight:

Table I

| Fatty Acids | Deacidified Palm Oil | Liquid Fraction | Solid Fraction I | Solid Fraction II | Solid Fraction I + II combin. |
|---|---|---|---|---|---|
| C12 | 0.75 | 0.05 | 0.85 | 0.70 | 0.75 |
| C14 | 0.85 | 0.50 | 0.90 | 0.85 | 0.85 |
| C16 | 44.85 | 34.32 | 56.75 | 49.80 | 54.17 |
| C18 | 2.15 | 2.00 | 3.20 | 2.20 | 2.90 |
| C18/1 | 40.70 | 51.10 | 31.33 | 37.72 | 33.70 |
| C18/2 | 10.70 | 12.03 | 6.97 | 8.73 | 7.63 |
| Fully saturated | 48.60 | 36.87 | 61.70 | 53.50 | 58.67 |
| Iodine value | 53 | 63 | 38 | 47 | 41.50 |

EXAMPLE 3

200 g of deacidified palm oil were mixed with 200 g of n-propanol containing 7.5% of water. The mixture was heated under stirring to 60° C and stirred at that temperature until a clear solution was obtained. The solution was then cooled rapidly to 25° C under stirring and stirring was continued at that temperature for 2 hours. The mixture was then transferred into a cooled decantation vessel and allowed to settle for 30 minutes, whereupon two layers were formed. The layers were separated by decantation and each was distilled to remove therefrom the n-propanol and the water.

The distillation residue obtained from the lower layer consisted of 150 g of liquid fraction having a chilled stability of 25° C.

The distillation residue of the upper layer consisted of 50 g of a solid fraction having a slip point of 48° C.

EXAMPLE 4

The procedure described in Example 3 was repeated except that instead of the aqueous n-propanol, 200 g of ethanol containing 2% of water were used as solvent.

After the mixture was transferred into the decantation vessel, it separated into two layers in about 15 minutes. The layers were separated by decantation and distilled to yield:

140 g of a liquid fraction having a chilled stability of 25° C, and 60 g of a solid fraction having a slip point of 46° C.

EXAMPLE 5

A series of experiments were carried out with different palm oils in order to determine the dependence of the yields of the various fractions on the saturated fatty acid content of the crude oil. Each type of palm oil was submitted both to the single stage procedure described in Example 1 above and to the double stage procedure described in Example 2. The solvent employed in all cases was isopropanol containing 5% by weight of water, at a weight ratio of 1 part of solvent per 1 part of oil. The crystallization temperature in the single stage experiments was 22° C and the crystallization temperatures in the first and the second stages of the double-stage procedure were 25° and 15° C respectively.

One set of experiments was conducted on crude oil which had been degummed, in which operation 2.5% of the oil were lost. The yields (calculated on the initial crude oil) are represented in the following Table II:

Table II

| Saturated Fatty Acids content in Crude Oil | SINGLE STAGE | | DOUBLE STAGE | | |
|---|---|---|---|---|---|
| | Liquid Fraction % | Solid Fraction % | Liquid Fraction % | 1st Solid Fraction % | 2nd Solid Fraction % |
| 46 | 78 | 19.5 | 63.5 | 20 | 14 |
| 48 | 73 | 24.5 | 58 | 25 | 14.5 |
| 50 | 68.5 | 29.0 | 53 | 29.5 | 15 |
| 52 | 66 | 31.5 | 49 | 32 | 16.5 |
| 54 | 61.5 | 36 | 44 | 36.5 | 17 |

A second set of experiments was carried out on crude oil which had been both degummed and deacidified, which processes involved a loss of 8% of the crude oil. The yields (calculated on the initial crude oil) are represented in the following Table III:

Table III

| Saturated Fatty Acids content in Crude Oil | SINGLE STAGE | | DOUBLE STAGE | | |
|---|---|---|---|---|---|
| | Liquid Fraction % | Solid Fraction % | Liquid Fraction % | 1st Solid Fraction % | 2nd Solid Fraction % |
| 46 | 77.5 | 14.5 | 63 | 15 | 14 |
| 48 | 72.5 | 19.5 | 61.5 | 16.5 | 14 |
| 50 | 67.5 | 24.5 | 52 | 25 | 15 |
| 52 | 65.5 | 26.5 | 48 | 27 | 17 |
| 54 | 61 | 31 | 41.5 | 32 | 18.5 |

As could have been expected, the results in Tables II and III show that the lower the saturated fatty acid content of the oil, the higher the yields of the liquid fraction and the lower the yields of the solid fraction. The results also show that the yields obtained from deacidified oil are better than those obtained with oil which had merely been degummed. Thus, for example, the degummed oil with the saturated fatty acid content of 48% and containing 5% F.F.A., when submitted to the double-stage fractional crystallization after being merely degummed, yielded 59.4% (based on initial degummed oil) of liquid fraction containing about 1.5% F.F.A. The yield calculated as oil with 0.1% F.F.A. is 58.5%. If the same oil is deacidified prior to the fractional crystallization, the yield of the liquid fraction is 62.5% of deacidified oil, the liquid fraction containing 0.1% F.F.A.

EXAMPLE 6

200 g of deacidified cottonseed oil were mixed with 120 g of isopropanol containing 5% by weight of water. The mixture was heated under stirring to 60° C and the clear solution thus obtained was cooled rapidly to 5° C and stirred at that temperature for 6 hours. The mixture was transferred into a cooled decantation vessel wherein it separated into two layers in less than 20 minutes. The layers were separated by decantation and each distilled in order to remove isopropanol and water.

The lower layer (208 g) yielded 180 g of liquid fraction having a chilled stability of 6° C and an iodine value of 115.

The upper layer (112 g) yielded 20 g of a solid fraction having a slip point of 33° C and an iodine value of 76.

EXAMPLE 7

(A) 200 g of deacidified rice bran oil were mixed with 10 g of a hard oil having a slip point of 48° C and with 120 g of isopropanol containing 5% by weight of water. The mixture was heated under stirring to 60° C and the solution thus obtained was cooled rapidly to 15° C and stirred at that temperature for 2 hours. The mixture was then transferred into a cooled decantation vessel where it separated into two layers in less than 20 minutes. The layers were separated by decantation and the lower layer (221 g) distilled to yield a residue of 185 g of liquid fraction which did not contain any waxes and had a chilled stability of 20° C.

The upper layer (109 g) was heated under stirring to 45° C for 30 minutes and transferred into a decantation vessel which was maintained at a temperature of 45° C. After less than 20 minutes a separation into two layers took place. The layers were separated and distilled separately to remove the isopropanol and the water. The residue from the upper layer consisted in 15 g of oil which contained the 10 g of the hard oil, while the residue from the distillation of the lower layer contained 8 g of waxes and 2 g of triglycerides and had a slip point of 78° C.

(B) 185 g of the liquid fraction obtained above were submitted to a second stage fractional crystallization from 185 g of isopropanol containing 5% by weight of water in accordance with the procedure described in Example 6 (crystallization temperature 5° C). There were thus obtained:

a liquid fraction (170 g) having a chilled stability of 6° C and an iodine value of 101; and a solid fraction (15 g) having a slip point of 32° C and an iodine value of 72.

EXAMPLE 8

200 g of partially hydrogenated soybean oil containing 0.5% linolenic acid and having an iodine value of 90 were mixed with 200 g of isopropanol containing 5% by weight of water. The mixture was heated with stirring to 60° C and the clear solution thus obtained was cooled rapidly to 25° C and stirred at this temperature for 2 hours. The mixture was then transferred into a cooled decantation vessel wherein it separated into two layers in less than 10 minutes. The layers were separated by decantation and the lower layer (207 g) containing 47 g of aqueous isopropanol was mixed with additional 113 g of isopropanol containing 5% by weight of water. The procedure described above was repeated at a crystallization temperature of 5° C. In the decantation vessel the separation of the two layers occurred in less than 20 minutes. The layers were separated by decantation.

The lower layer (162 g) was distilled to yield as a residue a liquid fraction (140 g) having an iodine value of 100 and a chilled stability of 6° C.

The upper layer (158 g) was combined with the upper layer obtained in the first stage and the mixture was distilled in order to remove isopropanol and water. The obtained residue consisted of 60 g of a solid fraction having a slip point of 33° C and an iodine value of 66.

I claim:

1. A process for separating an edible oil selected from the group consisting of natural and semi-processed animal and vegetable oils and fats and mixtures thereof into a less saturated fraction (liquid fraction) and a more saturated fraction (solid fraction) comprising the steps of:

dissolving one part by weight of the oil in about 0.5 to about 4 parts by weight of a solvent consisting of a $C_2$–$C_3$ alkanol containing about 2 to about 10% by weight of water at a dissolution temperature of above about 40° C, rapidly cooling the resulting solution to a crystallization temperature lower than the dissolution temperature, thereby to cause formation of substantially spherical shaped alpha-form crystals of said more saturated fraction of the oil capable of floating in said solvent, allowing said mixture to separate into three phases consisting of a lower liquid layer comprising said less saturated fraction of the oil and a part of said solvent, an upper liquid layer comprising another part of said solvent, and a solid phase consisting of said crystals of said more saturated fraction of the oil, said solid phase floating in said upper liquid layer to form a suspension therein, and separating said lower liquid layer from said suspension by decantation.

2. A process according to claim 1, wherein the alkanol contains from about 4 to about 6% by weight of water.

3. A process according to claim 1, wherein from about 1 to about 2 parts by weight of the aqueous alkanol are used for each part of the oil.

4. A process according to claim 1, wherein the alkanol is isopropanol.

5. A process according to claim 1, wherein the product solid and/or liquid fractions of the oil are stripped from residual amounts of alkanol and water under vacuum, by passing therethrough a controlled stream of a dry, inert gas.

6. A process according to claim 1, wherein a liquid fraction product obtained in a first separation operation is subjected directly to a second separation operation according to claim 1, in the course of which the solution is cooled to a lower temperature than in the first operation.

7. A process according to claim 1, wherein the oil is palm oil.

8. A process according to claim 1, wherein the oil is cottonseed oil.

9. A process according to claim 1, wherein the oil is sunflower seed oil.

10. A process according to claim 1, wherein the oil is kapok seed oil.

11. A process according to claim 1, wherein the oil is partially hydrogenated soybean oil.

12. A process according to claim 1, wherein the oil is a dewaxed oil.

13. A process according to claim 12, wherein the oil is rice bran oil which is dewaxed by mixing it with about 1 to 5% by weight of a hard fat of a comparatively high melting point, and submitting the mixture to a separation according to claim 1, the waxes being obtained together with the hard fat as solid fraction in the upper layer.

14. A process according to claim 13, wherein the waxes are recovered from the isolated upper layer by heating the latter to about 45° C whereupon it stratifies into a lower layer comprising the melted waxes and some of the aqueous alkanol, and an upper layer comprising a solution of the hard fat in the remainder of the alkanol, separating the two layers from each other by decantation at about 45° C and distilling the lower layer in order to remove the alkanol and the water and to recover the waxes as the distillation residue.

15. A process according to claim 14, wherein the upper layer is recycled for use in a subsequent dewaxing operation according to claim 14.

16. A process according to claim 1, comprising preliminary degumming and deacidification of the oil.

17. A process according to claim 1, comprising pretreating the oil for reduction of glycerides content.

18. A process according to claim 1, which comprises stirring the mixture of said alpha-form crystals and residual solution, which results from said rapid cooling, at said crystallization temperature for about 2 to about 6 hours, thereby causing said crystals to agglomerate into small spherically shaped aggregates.

19. A process according to claim 1, wherein the following said decanting, the lower liquid layer and the suspension are separately subjected to distillations thereby to remove the solvent as distillate and to recover, respectively, said less saturated fraction and said more saturated fraction of the oil as distillation residues.

* * * * *